US011312135B2

(12) United States Patent
Sasaki

(10) Patent No.: US 11,312,135 B2
(45) Date of Patent: Apr. 26, 2022

(54) LIQUID EJECTING HEAD

(71) Applicant: CANON KABUSHIKI KAISHA, Tokyo (JP)

(72) Inventor: Koji Sasaki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/068,305

(22) Filed: Oct. 12, 2020

(65) Prior Publication Data

US 2021/0114374 A1 Apr. 22, 2021

(30) Foreign Application Priority Data

Oct. 16, 2019 (JP) ..... JP2019-189493

(51) Int. Cl.
*B41J 2/14* (2006.01)
*B41J 2/18* (2006.01)

(52) U.S. Cl.
CPC ..... *B41J 2/1404* (2013.01); *B41J 2/14145* (2013.01); *B41J 2/18* (2013.01); *B41J 2/14201* (2013.01); *B41J 2002/14306* (2013.01); *B41J 2202/12* (2013.01)

(58) Field of Classification Search
CPC ..... B41J 2/1404; B41J 2/18; B41J 2/14145; B41J 2202/12; B41J 2002/14306; B41J 2/14201
See application file for complete search history.

(56) References Cited

U.S. PATENT DOCUMENTS 10,207,516 B2 * 2/2019 Govyadinov ..... B41J 2/14056

FOREIGN PATENT DOCUMENTS

JP 5700879 B2 4/2015

* cited by examiner

*Primary Examiner* — Geoffrey S Mruk
(74) *Attorney, Agent, or Firm* — Canon U.S.A., Inc. I.P. Division

(57) ABSTRACT

A liquid ejecting head which has a supply path that is used to supply a liquid and a circulation flow path that branches from the supply path and is joined to the supply path again, and communicates with an ejection orifice for ejecting the liquid. The circulation flow path has an energy generating element that is provided facing the ejection orifice and generates energy for ejecting the liquid, and a liquid feed element that is used to circulate the liquid. The energy generating element and the liquid feed element are located at different distances from the supply path, and the circulation flow path has a pressure chamber provided with the energy generating element at a position farthest from the supply path.

20 Claims, 6 Drawing Sheets

LIQUID EJECTING HEAD

BACKGROUND

Field of the Disclosure

The present disclosure generally relates to a liquid ejecting head having a liquid circulation mechanism.

Description of the Related Art

A liquid ejecting head having a liquid circulation mechanism is described in Japanese Patent No. 5700879. The liquid ejecting head includes a substrate provided with a supply path used to supply a liquid, and a plurality of jetting elements for ejecting the liquid from ejection orifices are arranged in a line on the substrate. A fluid pump is provided between the jetting elements every two adjacent jetting elements on the substrate. A circulation flow path is formed in each fluid pump. The circulation flow path has a flow path that is directed from the supply path toward two adjacent jetting elements and a flow path that returns from each jetting element to the supply path, and the fluid pump disposed between the jetting elements circulates a liquid.

However, in the liquid ejecting head described in Japanese Patent No. 5700879, since the fluid pump is provided between the jetting elements, reducing an interval between the jetting elements and increasing the density of the ejection orifices are not easy.

SUMMARY

According to an aspect of the present disclosure, there is provided a liquid ejecting head having a supply path that is used to supply a liquid; and a circulation flow path that branches from the supply path and is joined to the supply path again, and communicates with an ejection orifice for ejecting the liquid. The circulation flow path has an energy generating element that is provided facing the ejection orifice and generates energy for ejecting the liquid, and a liquid feed element that generates energy to circulate the liquid. The energy generating element and the liquid feed element are located at different distances from the supply path. The circulation flow path has a pressure chamber provided with the energy generating element at a position farthest from the supply path.

Further features of the present disclosure will become apparent from the following description of exemplary embodiments with reference to the attached drawings.

DESCRIPTION OF THE EMBODIMENTS

Hereinafter, embodiments of the present disclosure will be described in detail with reference to the drawings. However, the constituent elements described in the embodiments are only examples, and are not intended to limit the scope of the present disclosure thereto.

Figure 1:
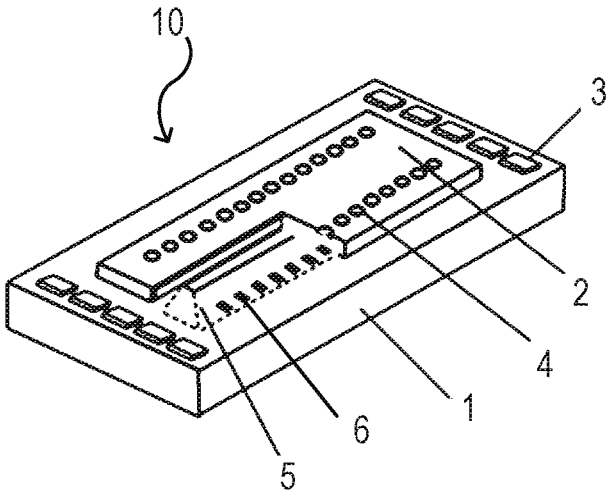
FIG. 1 is a schematic diagram for describing a schematic structure of an element board of a liquid ejecting head according to an embodiment of the present disclosure.

FIG. 1 is a schematic diagram for describing a schematic structure of an element board of a liquid ejecting head according to an embodiment of the present disclosure.

As illustrated in FIG. 1, an element board 10 has a substrate 1 provided with a supply path 5 for supplying a liquid, and a flow path formation member 2 having a plurality of ejection orifices 4 and a plurality of terminals 3 are formed on the substrate 1. The substrate 1 is made of, for example, silicon. The liquid is, for example, ink. The terminals 3 are provided on both sides (both ends) of the substrate 1, and the power required to eject and circulate the liquid is supplied to the terminals 3.

The supply path 5 is a through-hole penetrating through the substrate 1 and is formed to extend in a longitudinal direction of the substrate 1. Energy generating element arrays in which a plurality of energy generating elements 6 are arranged in a line at a predetermined interval are provided on both sides of an opening of the supply path 5 on the substrate 1. The energy generating element 6 is driven by electric power supplied to the terminal 3 and generates energy for ejecting the liquid from the ejection orifice 4. For example, as the energy generating element 6, a heating resistance element or a piezoelectric element that generates heat energy may be used. The heating resistance element is, for example, a thermal resistor. The piezoelectric element is, for example, a piezoelectric actuator.

The flow path formation member 2 is a member that forms a flow path via which the liquid is supplied and circulated. For example, the flow path formation member 2 forms a circulation flow path that branches from the supply path 5 and is joined to the supply path 5 again, and communicates with the ejection orifice 4 therebetween. The circulation flow path includes the energy generating element 6 that generates energy for ejecting the liquid from the ejection orifice 4. Each ejection orifice 4 and each energy generating element 6 are provided to face each other. A pressure chamber having the energy generating element 6 therein is formed for each ejection orifice 4. The supply path 5 can be used to supply the liquid to each pressure chamber via the circulation flow path.

Figure 2:
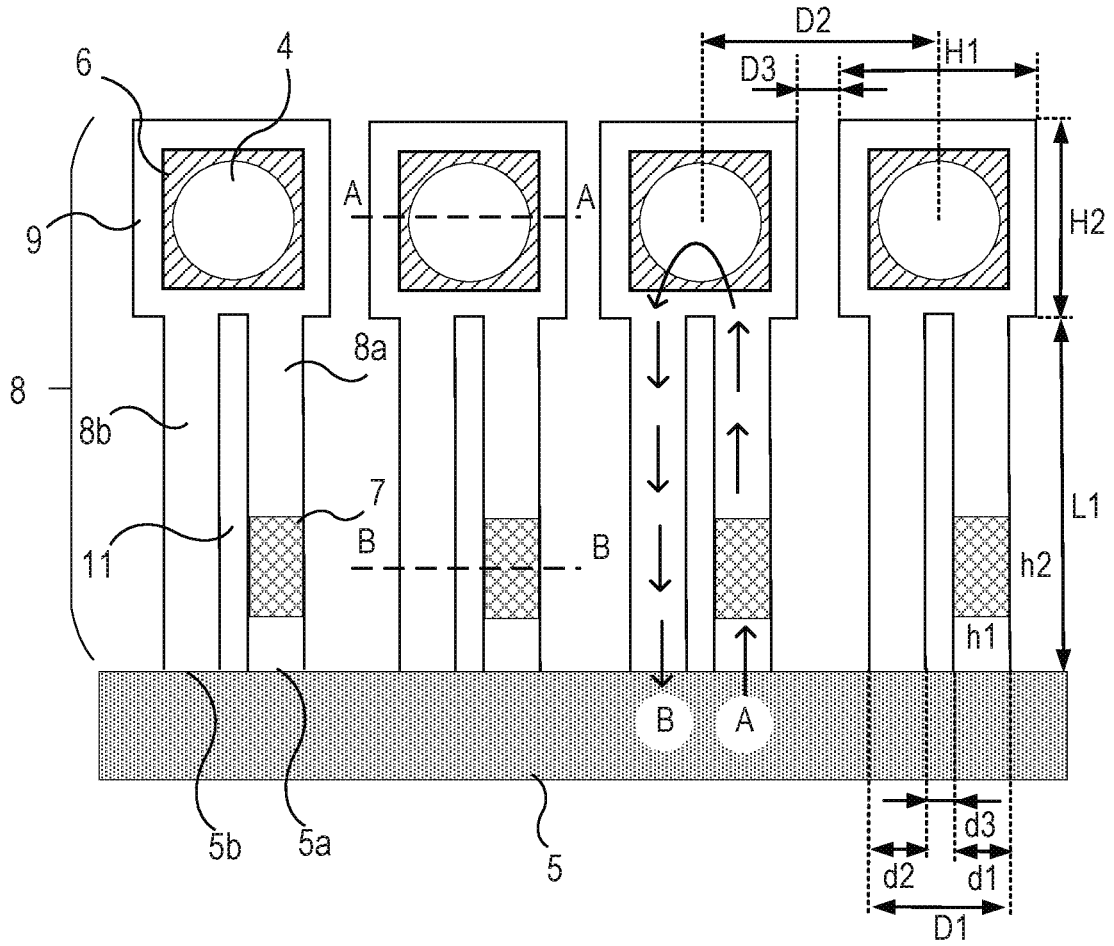
FIG. 2 is a schematic diagram for describing a liquid circulation mechanism of the liquid ejecting head illustrated in FIG. 1.

FIG. 2 is a schematic diagram for describing the liquid circulation mechanism of the liquid ejecting head illustrated in FIG. 1. FIG. 2 schematically illustrates a configuration of the circulation flow path formed by the flow path formation member 2 when viewed from a direction perpendicular to the substrate 1.

As illustrated in FIG. 2, the flow path formation member 2 has a circulation flow path 8 that branches from the supply path 5 and is joined to the supply path 5 again, and communicates with the ejection orifice 4 therebetween. The circulation flow path 8 is provided for each ejection orifice 4. The circulation flow path 8 has the energy generating element 6 provided to face the ejection orifice 4, and a liquid feed element 7 used to circulate a liquid. The energy generating element 6 and the liquid feed element 7 are located at different distances from the supply path 5. Herein, the liquid feed element 7 is located further toward the supply path 5 side than the energy generating element 6.

The circulation flow path 8 has a pressure chamber 9 provided with the energy generating element 6 at a position farthest from the supply path 5. The pressure chamber 9 indicates a region where energy for ejecting a liquid is generated, and may not be a chamber having a clear boundary. For example, when the energy generating element 6 is a heating resistance element that generates heat energy, the pressure chamber 9 may be a foaming chamber indicating a foaming area during liquid ejection.

Here, a specific structure of the circulation flow path 8 will be described. The circulation flow path 8 includes a first flow path 8*a* that connects a branch portion 5*a* from the supply path 5 to the pressure chamber 9, and a second flow path 8*b* that connects a joint portion 5*b* with the supply path 5 to the pressure chamber 9, and a partition wall 11 for partitioning the first flow path 8*a* from the second flow path 8*b*. The first flow path 8*a* is a flow path used to supply the liquid to the pressure chamber 9, and the second flow path 8*b* is a flow path used to collect the liquid from the pressure chamber 9. The liquid feed element 7 is provided in the first flow path 8*a*. As long as the liquid can be circulated, the liquid feed element 7 may be provided in the second flow path 8*b*, and may be provided in both of the first flow path 8*a* and the second flow path 8*b*. The liquid feed element 7 is driven by electric power supplied to the terminal 3. As the liquid feed element 7, the above-described heating resistance element or piezoelectric element may be used. Specifically, a piezoelectric actuator pump, an electrostatic pump, or an electrohydrodynamic pump may be used as the liquid feed element 7.

When the liquid feed element 7 is driven, the liquid flows into the first flow path 8*a* from the supply path 5. The liquid flowing into the first flow path 8*a* passes through the pressure chamber 9 due to the inertial force, and returns to the supply path 5 via the second flow path 8*b*. In other words, the liquid feed element 7 can circulate the liquid to pass through the first flow path 8*a*, the pressure chamber 9, and the second flow path 8*b* in this order. In FIG. 2, this liquid circulation path is indicated by solid arrows. The circulation path starts from a point "A", passes through the first flow path 8*a*, the pressure chamber 9, and the second flow path 8*b* in this order, and ends at a point "B".

Figure 3A:
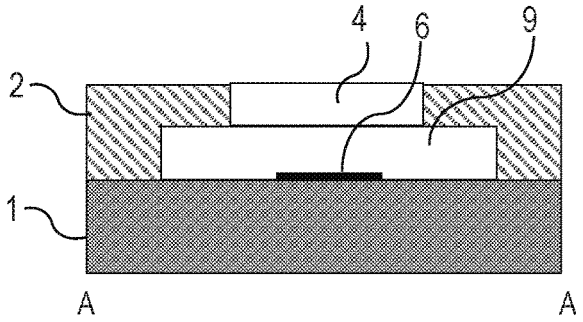
FIG. 3A is a schematic diagram illustrating a sectional structure of the liquid ejecting head illustrated in FIG. 2.
Figure 3B:
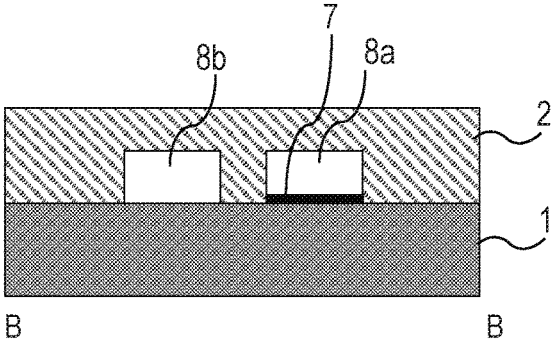
FIG. 3B is a schematic diagram illustrating a sectional structure of the liquid ejecting head illustrated in FIG. 2.

FIGS. 3A and 3B schematically illustrate sectional structures of the pressure chamber 9, the first flow path 8*a* and the second flow path 8*b* illustrated in FIG. 2. In FIGS. 3A and 3B, FIG. 3A schematically illustrates a sectional structure in a case where the portion of the pressure chamber 9 is taken along the dashed line A-A, and FIG. 3B schematically illustrates a sectional structure in a case where the portions of the first flow path 8*a* and the second flow path 8*b* are taken along the dashed line B-B.

As illustrated in FIG. 3A, the flow path formation member 2 having the ejection orifice 4 is formed on the substrate 1. The flow path formation member 2 has the pressure chamber 9 that communicates with the ejection orifice 4. The energy generating element 6 is formed at a position facing the ejection orifice 4 on the substrate 1 in the pressure chamber 9.

As illustrated in FIG. 3B, the first flow path 8*a* and the second flow path 8*b* are formed on the substrate 1. A flow path sectional shape of the first flow path 8*a* is a rectangular shape, and a flow path sectional shape of the second flow path 8*b* is also a rectangular shape. A flow path sectional area of the first flow path 8*a* is the same as a flow path sectional area of the second flow path 8*b*. The liquid feed element 7 is formed on the substrate 1 in the first flow path 8*a*.

Herein, as an example, each of the energy generating element 6 and the liquid feed element 7 has a thermal resistor having a thin film layer formed by forming, for example, an oxide layer (not illustrated) on the substrate 1. The thin film layer includes an oxide layer, a metal layer, a conductive trace and a passivation layer.

According to the liquid ejecting head of the present embodiment, the energy generating element 6 and the liquid feed element 7 are located at different distances from the supply path 5, and thus the liquid feed element 7 is not interposed between the energy generating elements 6. The circulation flow path 8 circulates the liquid between the pressure chamber 9 and the supply path 5. Therefore, the density of the ejection orifices 4 can be increased while maintaining the liquid circulation function.

Hereinafter, the operation and effect of the liquid ejecting head of the present embodiment will be described in detail with reference to a comparative example.

Figure 6:
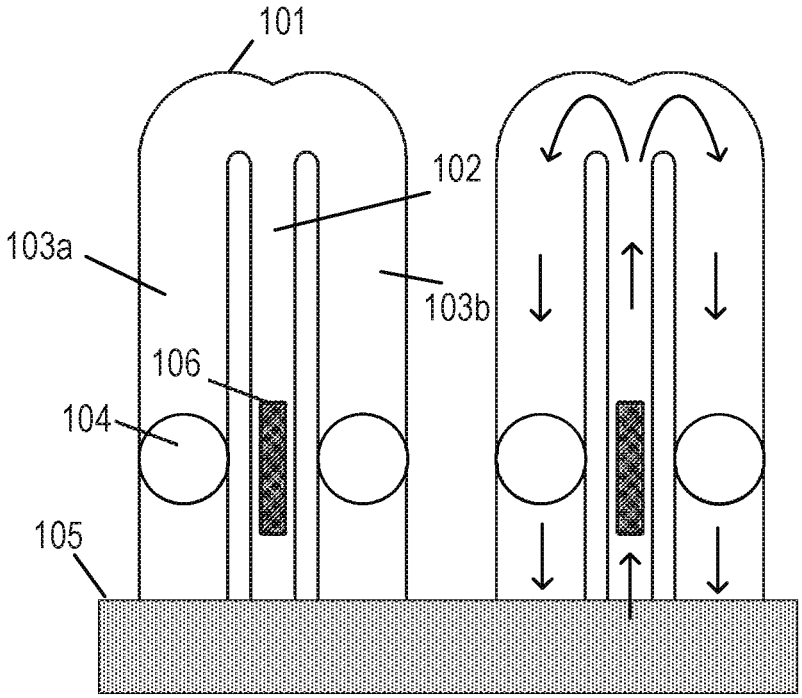
FIG. 6 is a schematic diagram for describing a liquid circulation mechanism of a liquid ejecting head according to a comparative example.

FIG. 6 schematically illustrates a liquid circulation mechanism of a liquid ejecting head according to a comparative example.

The liquid ejecting head illustrated in FIG. 6 has a plurality of ejection orifices 104 arranged in a line at equal intervals. A supply path 105 used to supply a liquid is provided on a substrate along an ejection orifice array. A jetting element (not illustrated) that ejects the liquid from the ejection orifice 104 is provided at a position facing each ejection orifice 104 on the substrate. A fluid pump 106 is provided between every two adjacent jetting elements on the substrate. A circulation flow path 101 is formed for each fluid pump 106. Here, the jetting element corresponds to an energy generating element.

The circulation flow path 101 has a flow path 102 including the fluid pump 106, and two flow paths 103*a* and 103*b* provided to sandwich the flow path 102. Each of the flow paths 103*a* and 103*b* is configured such that one end thereof communicates with the supply path 105 and the other end thereof communicates with the supply path 105 via the flow path 102. One of the two adjacent jetting elements is disposed in the flow path 103*a*, and the other is disposed in the flow path 103*b*. By driving the fluid pump 106, the liquid flows into the flow paths 103*a* and 103*b* from the supply path 105 via the flow path 102, and then the liquid returns to the supply path 105 from the flow paths 103*a* and 103*b*.

In order to realize the high density of the ejection orifices, an interval between the jetting elements that are energy generating elements are required to be small. In the liquid ejecting head illustrated in FIG. 6, since the fluid pump 106 that is a liquid feed element is interposed between the jetting elements that are energy generating elements, reducing a distance between the jetting elements is difficult.

In contrast, in the liquid ejecting head of the present embodiment, the liquid feed element 7 is provided between the energy generating element 6 and the supply path 5. In other words, the liquid feed element 7 is not interposed between the energy generating elements 6. Therefore, an interval between the energy generating elements 6 can be reduced, and thus the density of the ejection orifices 4 can be increased compared with the liquid ejecting head illustrated in FIG. 6.

In the pressure chamber 9, the viscosity of a liquid may increase due to evaporation of the liquid from the ejection orifice 4 and foreign substances such as bubbles may be generated during stoppage of a liquid ejection operation. In the liquid ejecting head of the present embodiment, the liquid feed element 7 can circulate a liquid such that the liquid passes through the first flow path 8*a*, the pressure chamber 9, and the second flow path 8*b* in this order. Due to the circulation of the liquid, the increase in the viscosity of the liquid in the pressure chamber 9 can be suppressed, and thus foreign substances can be removed from the pressure chamber 9.

Hereinafter, as an example, dimensions of each portion of the liquid ejecting head in which the density of the ejection orifices 4 is increased will be described in detail. Here, the density of the ejection orifices 4 is 600 nozzles per column inch (NPCI). This indicates that, regarding a column of the ejection orifices 4 arranged on one side of the supply path 5, 600 ejection orifices 4 are arranged per inch. The ejection orifices 4 are arranged on the other side of the supply path 5 at the same density. Therefore, the ejection orifices 4 may be treated to be provided with a density of 1,200 dots/inch (dpi) for the single supply path 5. For example, the density of 1,200 dpi may be realized by arranging the ejection orifices in each column in a zigzag manner.

The ejection orifice 4 has a substantially circular shape and is disposed at the center of the upper surface of the pressure chamber 9. In a case where the ejection orifices 4 are evenly arranged at 600 NPCI, an interval D2 between the ejection orifices 4 is, for example, 42 μm. An interval D3 between the pressure chambers 9 is, for example, 7 μm. A shape of the pressure chamber 9 when viewed from a direction perpendicular to the substrate 1 is a rectangular shape with H1 (horizontal)×H2 (vertical). Here, both of H1 and V1 are 35 μm. The energy generating element 6 has, for example, a substantially square shape, and is disposed at the center of the bottom surface of the pressure chamber 9.

A length L1 of portions of the circulation flow path 8 other than the pressure chamber 9 (portions such as the partition wall 11, the first flow path 8*a* and the second flow path 8*b*) is, for example, 65 μm, and a width D1 thereof is, for example, 25 μm. A width d1 of the first flow path 8*a* and a width d2 of the second flow path 8*b* are the same as each other, and is, for example, 10 μm. A width d3 of the partition wall 11 is, for example, 5 μm. As the liquid feed element 7, a rectangular heating resistance element with h1 (width)×h2 (length) is used. h1 is, for example, 10 μm, and h2 is, for example, 18 μm.

The above-described dimensions of the respective portions are only examples, and may be changed as appropriate according to a desired density of ejection orifices. For example, a size of each portion may be adjusted to cope with a density such as 1200 NPCI (2400 dpi). For example, in the above-described embodiment, the magnitude relationship between the width D1 of the portions of the circulation flow path 8 other than the pressure chamber and the width H1 of the pressure chamber 9 is D1<H1, but the present disclosure is not limited thereto. The magnification relationship may be D1>H1, and may be D1=H1.

One of a shape or a dimension of each of the energy generating element 6 and the liquid feed element 7 may be changed as appropriate such that stable liquid ejection and circulation can be performed. For example, one of a shape and a size of the liquid feed element 7 may be adjusted to achieve a desired pumping effect.

The above-described liquid ejecting head of the present embodiment is an example of the present disclosure, and a configuration thereof may be changed as appropriate.

Hereinafter, modification examples of the liquid ejecting head of the present embodiment will be described with reference to FIGS. 4A to 4E and 5F to 5I. In FIG. 4A to 4E, FIGS. 4A to 4E illustrate first to fifth modification examples. In FIGS. 5F to 5I, FIGS. 5F to 5I illustrate sixth to ninth modification examples.

First Modification Example

Figure 4A:
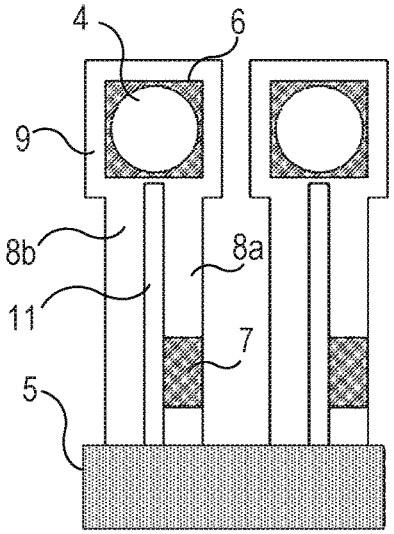
FIG. 4A is a schematic diagram for describing a modification example of the liquid ejecting head.

A liquid ejecting head according to a first modification example illustrated in FIG. 4A is different from the liquid ejecting head illustrated in FIGS. 2, 3A and 3B in that a length of the partition wall 11 is different from a length of the first flow path 8*a* and the second flow path 8*b*. In the liquid ejecting head of the present modification example, the partition wall 11 is longer than each of the first flow path 8*a* and the second flow path 8*b*. The end portion of the partition wall 11 on an opposite side to the supply path side enters the pressure chamber.

According to the liquid ejecting head of the present modification example, the end portion of the partition wall 11 on the opposite side to the supply path side extends into the pressure chamber 9, and thus a liquid in the pressure chamber 9 can be efficiently circulated.

In the path from the supply path 5 to the ejection orifice 4 via the first flow path 8*a* and the pressure chamber 9, with respect to the energy generating element 6, a resistance occurring in a flow path on the supply path 5 side (upstream side) will be referred to as a rear resistance, and a resistance occurring in a flow path on the ejection orifice 4 side (downstream side) will be referred to as a front resistance. In a case where the rear resistance is sufficiently larger than the front resistance, energy generated by the energy generating element 6 can be caused to concentrate in a direction of the ejection orifice 4, and thus a liquid can be ejected efficiently. However, in a case where the rear resistance is small, energy generated by the energy generating element 6 escapes rearward, and thus energy that does not contribute to ejection of the liquid increases. According to the liquid ejecting head of the present modification example, the rear resistance can be increased by increasing the length of the partition wall 11, so that a liquid can be ejected efficiently.

Second Modification Example

Figure 4B:
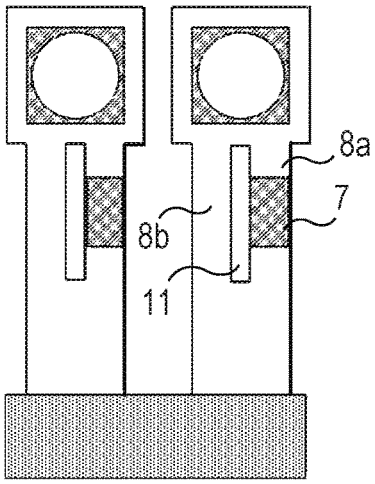
FIG. 4B is a schematic diagram for describing another modification example of the liquid ejecting head.

A liquid ejecting head according to the second modification example illustrated in FIG. 4B is different from the liquid ejecting head illustrated in FIGS. 2, 3A and 3B in that the partition wall 11 is shortened. In the liquid ejecting head of the present modification example, the partition wall 11 is shorter than a flow path length of the portions of the circulation flow path 8 other than the pressure chamber 9. Thus, the first flow path 8*a* and the second flow path 8*b* are shorter than those of the liquid ejecting head illustrated in FIGS. 2, 3A and 3B.

According to the liquid ejecting head of the present modification example, the partition wall 11 is shortened such that a flow path sectional area of the portion of the circulation flow path 8 on the supply path 5 side (the portion communicating with the supply path 5) can be increased. Therefore, the refilling property at the time of ejecting a liquid can be ensured.

Third Modification Example

Figure 4C:
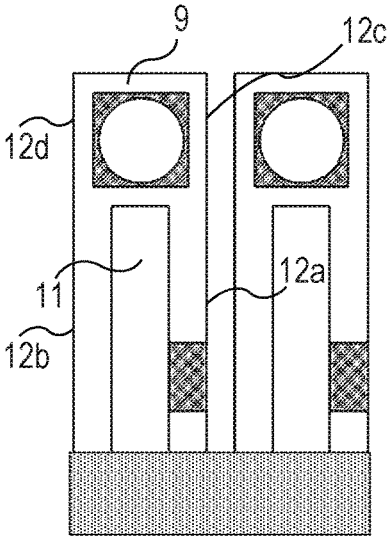
FIG. 4C is a schematic diagram for describing still another modification example of the liquid ejecting head.

A liquid ejecting head according to a third modification example illustrated in FIG. 4C is different from the liquid ejecting head illustrated in FIGS. 2, 3A and 3B in that there is no step in the communicating portion between the circulation flow path 8 and the pressure chamber 9. In the liquid ejecting head of the present modification example, opposing side surfaces of the circulation flow path 8 on the outer peripheral side are linearly formed. Specifically, the circulation flow path 8 has a first inner wall 12*a* and a second inner wall 12*b* that oppose each other with the partition wall 11 interposed therebetween, and the pressure chamber 9 has a third inner wall 12*c* and a fourth inner wall 12*d* that oppose each other. The first inner wall 12*a*, the second inner wall 12*b*, the third inner wall 12*c* and the fourth inner wall 12*d* are opposing side surfaces of the circulation flow path 8 on the outer peripheral side. The first inner wall 12*a* and the third inner wall 12*c* form a uniform plane, and the second inner wall 12*b* and the fourth inner wall 12*d* form a uniform plane. In other words, the first inner wall 12*a*, the second inner wall 12*b*, the third inner wall 12*c* and the fourth inner wall 12*d* are linearly formed. According to this structure, since there is no step on the inner wall of the communicating portion between the circulation flow path 8 and the pressure chamber 9, disturbance is unlikely to occur in a flow of a liquid when the liquid is circulated when the liquid is circulated, and, as a result, the liquid can be efficiently circulated.

Fourth Modification Example

Figure 4D:
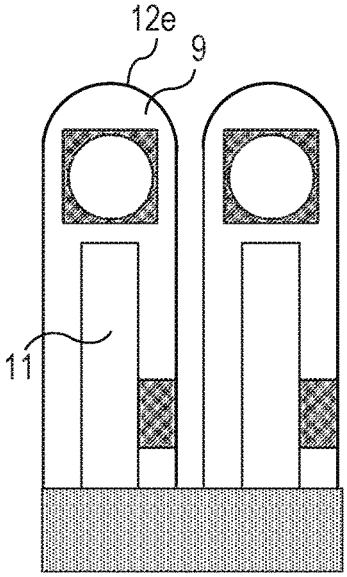
FIG. 4D is a schematic diagram for describing still another modification example of the liquid ejecting head.

A liquid ejecting head according to a fourth modification example illustrated in FIG. 4D is different from that according to the third modification example in that a direction changing portion of the circulation flow path 8 is formed in a curved shape. In the circulation flow path 8, a direction in which a liquid flows changes at a portion of a fifth inner wall 12*e* of the pressure chamber 9 that is a surface facing the end portion of the partition wall 11. In other words, the portion of the fifth inner wall 12*e* is the direction changing portion of the circulation flow path 8. In the liquid ejecting head of the present modification example, the fifth inner wall 12*e* is formed in a curved shape. For example, the fifth inner wall 12*e* has a round recess surface. Consequently, compared with the third modification example, disturbance is more unlikely to occur in a flow of a liquid when the liquid is circulated.

Fifth Modification Example

Figure 4E:
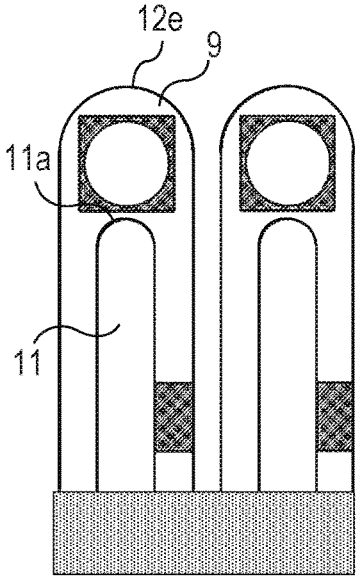
FIG. 4E is a schematic diagram for describing still another modification example of the liquid ejecting head.

A liquid ejecting head according to a fifth modification example illustrated in FIG. 4E is different from that according to the fourth modification example in that an end portion 11*a* of the partition wall 11 is formed in a curved shape. In the liquid ejecting head of the present modification example, when viewed from the direction perpendicular to the substrate 1, the end portion 11*a* of the partition wall 11 on the opposite side to the supply path side is formed in a curved shape protruding to the opposite side to the supply path side. For example, the end portion 11*a* of the partition wall 11 has a round protruding surface. Consequently, disturbance is more unlikely to occur in a flow of a liquid when the liquid is circulated than in the fourth modification example.

Sixth Modification Example

Figure 5F:
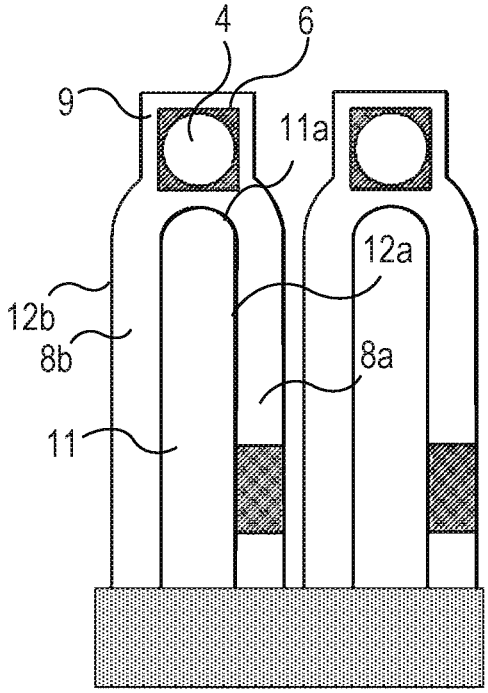
FIG. 5F is a schematic diagram for describing still another modification example of the liquid ejecting head.

A liquid ejecting head according to the sixth modification example illustrated in FIG. 5F is different from the liquid ejecting head illustrated in FIGS. 2, 3A and 3B in that the ejection orifice 4 is made small, and the inner wall of the communicating portion between the pressure chamber 9 and the first flow path 8*a* and the second flow path 8*b* is formed in a curved shape. In the liquid ejecting head of the present modification example, the ejection orifices 4 are smaller than those of the liquid ejecting head illustrated in FIGS. 2, 3A and 3B, and this is advantageous for increasing the density of the ejection orifices 4.

In the liquid ejecting head of the present modification example, the circulation flow path 8 has a first inner wall 12*a* and a second inner wall 12*b* that oppose each other with the partition wall 11 interposed therebetween. Portions of the first inner wall 12*a* and the second inner wall 12*b* on the pressure chamber 9 side are formed in a curved shape. For example, the portions of the first inner wall 12*a* and the second inner wall 12*b* on the pressure chamber 9 side are formed of round recess surfaces. The end portion 11*a* of the partition wall 11 on the pressure chamber 9 side is formed in a curved shape protruding to the opposite side to the supply path side. For example, the end portion 11*a* of the partition wall 11 has a round protruding surface. Consequently, disturbance is unlikely to occur in a flow of a liquid when the liquid is circulated, and thus the liquid can be circulated efficiently.

Seventh Modification Example

Figure 5G:
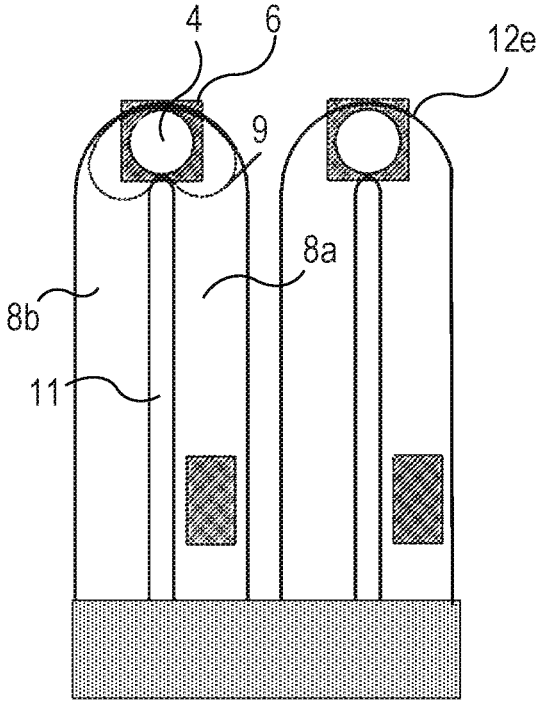
FIG. 5G is a schematic diagram for describing still another modification example of the liquid ejecting head.

A liquid ejecting head according to a seventh modification example illustrated in FIG. 5G is different from that according to the sixth modification example in that widths of the first flow path 8*a* and the second flow path 8*b* are increased, and the direction changing portion of the circulation flow path 8 is formed in a curved shape. Similar to the sixth modification example, since the ejection orifice 4 is small, this is advantageous for increasing the density of the ejection orifices 4. In the liquid ejecting head of the present modification example, the first flow path 8*a* and the second flow path 8*b* communicate with each other, and the pressure chamber 9 is formed in the communicating portion. The portion of the fifth inner wall 12*e* of the pressure chamber 9, which is a surface facing the end portion of the partition wall 11, is a direction changing portion at which a liquid flowing direction changes. The portion of the fifth inner wall 12*e* is formed in a curved shape. Specifically, the fifth inner wall 12*e* has a round recess surface. Consequently, disturbance is more unlikely to occur in a flow of a liquid when the liquid is circulated than in the sixth modification example.

Compared with the sixth modification example, the width of the partition wall 11 is reduced and the widths of the first flow path 8*a* and the second flow path 8*b* are increased, so that the liquid can be efficiently circulated.

Eighth Modification Example

Figure 5H:
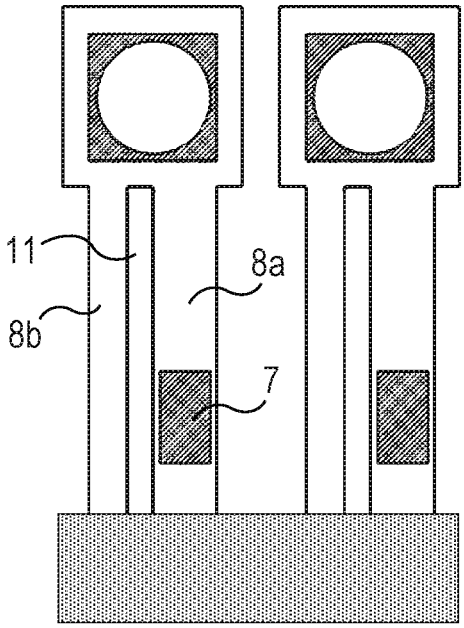
FIG. 5H is a schematic diagram for describing still another modification example of the liquid ejecting head.

A liquid ejecting head of the eighth modification example illustrated in FIG. 5H is different from the liquid ejecting head illustrated in FIGS. 2, 3A and 3B in that the widths of the first flow path 8*a* and the second flow path 8*b* are different from each other. In the liquid ejecting head of the present modification example, the width of the first flow path 8*a* is larger than the width of the second flow path 8*b* when viewed from the direction perpendicular to the substrate 1.

Generally, the width of the first flow path 8*a* (or the flow path sectional area) in which the liquid feed element 7 is provided is made larger than the width of the second flow path 8*b* (or the flow path sectional area), and thus the liquid circulation performance can be improved.

The width of the first flow path 8*a* is increased, and thus the degree of freedom in designing a size and a shape of the liquid feed element 7 is also improved.

Ninth Modification Example

Figure 5I:
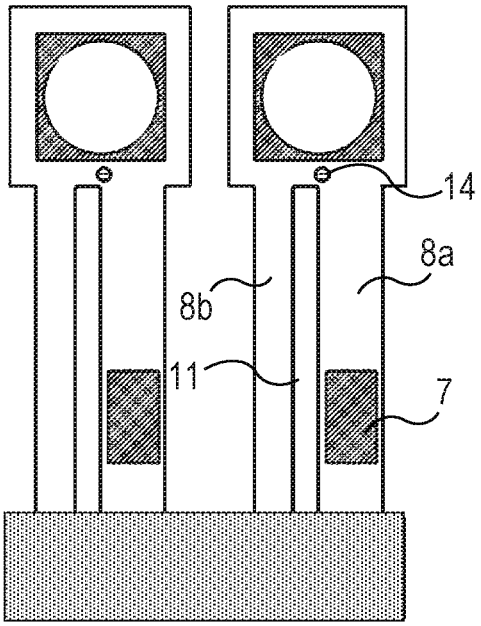
FIG. 5I is a schematic diagram for describing still another modification example of the liquid ejecting head.

A liquid ejecting head of a ninth modification example illustrated in FIG. 5I is different from the liquid ejecting head illustrated in FIGS. 2, 3A and 3B in that a protrusion 14 is provided at a position away from the side wall of the circulation flow path 8. In the liquid ejecting head of the present modification example, the protrusion 14 that is a structure separate from the partition wall 11 is formed in the portion of the pressure chamber 9 that communicates with the first flow path 8*a*. The protrusion 14 functions as a filter and can adjust a flow path resistance which is a resistance to a flow of a liquid directed toward the pressure chamber 9. As the protrusion 14, for example, a column body such as a cylinder or a prism, or a conical body such as a cone or a triangular pyramid may be used.

The protrusion 14 is a resistor to a flow of a liquid flowing into the pressure chamber 9 from the first flow path 8*a*. Therefore, one of a size and a shape of the protrusion 14 is adjusted, and thus the balance between the front resistance and the rear resistance can be adjusted. A disposition location and the number of the protrusions 14 may be changed as appropriate. For example, one or more protrusions 14 may be provided in one of the first flow path 8*a* and the second flow path 8*b*.

The above-described liquid ejecting head is an example of the present disclosure, and a configuration thereof may be changed as appropriate.

For example, in the above-described liquid ejecting head, two or more configurations among the configurations described in FIGS. 2 to 5I may be combined with each other.

In the above-described liquid ejecting head, as long as a liquid can be circulated, the liquid feed element 7 may be provided in the second flow path 8*b*, and may be provided in both of the first flow path 8*a* and the second flow path 8*b*.

In the above-described liquid ejecting head, both the liquid feed element 7 and the energy generating element 6 may include heating resistance elements which generate heat energy. Consequently, the number of manufacturing steps can be reduced.

In the above-described liquid ejecting head, both of the liquid feed element 7 and the energy generating element 6 may include piezoelectric elements. Also in this case, the number of manufacturing steps can be reduced.

The above-described liquid ejecting head of the present disclosure is applicable to a recording apparatus such as an inkjet printer that ejects a liquid to record information such as an image on a recording medium.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-189493, filed Oct. 16, 2019, which is here by incorporated by reference herein in its entirety.

What is claimed is:

1. A liquid ejecting head including a plurality of ejection orifices, comprising:

a substrate including a supply path that is used to supply a liquid to be ejected from the plurality of ejection orifices; and a flow path formation member in which a plurality of circulation flow paths is formed, wherein each of the plurality of circulation flow paths branches from the supply path and is joined to the supply path again, and communicates with only one of the plurality of ejection orifices, wherein each circulation flow path has an energy generating element that is provided facing the ejection orifice and generates energy for ejecting the liquid, and a liquid feed element that generates energy to circulate the liquid, wherein the energy generating element and the liquid feed element are located at different distances from the supply path, and wherein the circulation flow path has a pressure chamber provided with the energy generating element at a position farthest from the supply path.

2. The liquid ejecting head according to claim 1, wherein each circulation flow path includes a first flow path connecting a branch portion from the supply path to the pressure chamber, a second flow path connecting a joint portion with the supply path from the pressure chamber, and a partition wall partitioning the first flow path from the second flow path, and wherein the liquid feed element is provided in at least one of the first flow path and the second flow path.

3. The liquid ejecting head according to claim 2, wherein a flow path sectional area of the first flow path is different from a flow path sectional area of the second flow path.

4. The liquid ejecting head according to claim 3, wherein an end portion of the partition wall on an opposite side to the supply path side extends into the pressure chamber.

5. The liquid ejecting head according to claim 3, wherein an end portion of the partition wall on an opposite side to the supply path side is a convex curved shape extending toward the pressure chamber.

6. The liquid ejecting head according to claim 3, wherein the liquid feed element and the energy generating element include heating resistance elements that generate heat energy.

7. The liquid ejecting head according to claim 2, wherein the liquid feed element is provided in the first flow path, and wherein a flow path sectional area of the first flow path is larger than a flow path sectional area of the second flow path.

8. The liquid ejecting head according to claim 7, wherein an end portion of the partition wall on an opposite side to the supply path side extends into the pressure chamber.

9. The liquid ejecting head according to claim 7, wherein an end portion of the partition wall on an opposite side to the supply path side is a convex curved shape extending toward the pressure chamber.

10. The liquid ejecting head according to claim 2, wherein an end portion of the partition wall on an opposite side to the supply path side extends into the pressure chamber.

11. The liquid ejecting head according to claim 2, wherein an end portion of the partition wall on an opposite side to the supply path side is a convex curved shape extending toward the pressure chamber.

12. The liquid ejecting head according to claim 2, wherein a centerline of the first flow path is parallel to a centerline of the second flow path, each centerline extending from the supply path to the pressure chamber.

13. The liquid ejecting head according to claim 12 wherein the ejection orifice in communication with the circulation flow path is disposed between the centerlines.

14. The liquid ejecting head according to claim 2, wherein the partition wall extends parallel to each of the centerlines of the first flow path and the second flow path.

15. The liquid ejecting head according to claim 1, wherein a width of a portion of the circulation flow path other than the pressure chamber is different from a width of the pressure chamber.

16. The liquid ejecting head according to claim 1, wherein opposing side surfaces of the circulation flow path on an outer peripheral side are formed in a linear shape.

17. The liquid ejecting head according to claim 1, wherein a direction changing portion of the circulation flow path is formed in a curved shape.

18. The liquid ejecting head according to claim 1, wherein the liquid ejecting head has a protrusion at a position away from a side wall of the circulation flow path.

19. The liquid ejecting head according to claim 1, wherein the liquid feed element and the energy generating element include heating resistance elements that generate heat energy.

20. The liquid ejecting head according to claim 1, wherein the liquid feed element and the energy generating element include piezoelectric elements.

* * * * *